US005634457A

United States Patent [19]

Maruko

[11] Patent Number: 5,634,457

[45] Date of Patent: Jun. 3, 1997

[54] GAS HEATING APPARATUS

[75] Inventor: Saburo Maruko, Kanagawa-ken, Japan

[73] Assignee: Nippon Chemical Plant Consultant Co., Ltd., Japan

[21] Appl. No.: 491,372

[22] Filed: Jun. 16, 1995

Related U.S. Application Data

[62] Division of Ser. No. 124,035, Sep. 21, 1993, abandoned.

[30] Foreign Application Priority Data

Sep. 30, 1992 [JP] Japan ..... 4-283644

[51] Int. Cl.[6] ..... F24C 3/00

[52] U.S. Cl. ..... 126/91 A; 126/91 R; 126/92 AC; 126/92 R

[58] Field of Search ..... 126/91 A, 91 R, 126/92 AC, 92

[56] References Cited

U.S. PATENT DOCUMENTS

| | | | |
|---|---|---|---|
| 950,599 | 3/1910 | McGerry | 392/491 |
| 1,257,568 | 2/1918 | Wilson | 392/485 |
| 3,444,925 | 5/1969 | Johnson | 165/166 |
| 3,779,710 | 12/1973 | Burstein | 219/553 |
| 3,927,300 | 12/1975 | Wada et al. | 392/485 |
| 3,956,188 | 5/1976 | Hindin | 502/302 |
| 4,093,816 | 6/1978 | Case | 126/91 A |
| 4,114,685 | 9/1978 | Schwartz et al. | 165/96 |
| 4,643,667 | 2/1987 | Fleming | 431/7 |
| 4,730,599 | 3/1988 | Kendall et al. | 126/91 A |
| 4,798,192 | 1/1989 | Maruko | 126/92 AC X |
| 4,848,315 | 7/1989 | Adler | 126/91 R X |
| 5,058,196 | 10/1991 | Nakamura et al. | 126/91 R X |
| 5,213,780 | 5/1993 | Helfritch | 423/239 |
| 5,232,358 | 8/1993 | Maruko | 431/236 |
| 5,254,840 | 10/1993 | Thompson | 392/485 |

FOREIGN PATENT DOCUMENTS

| | | |
|---|---|---|
| 0465184 | 1/1992 | European Pat. Off. . |
| 3126267A1 | 1/1983 | Germany . |

OTHER PUBLICATIONS

Patent Abstract of Kokai No. 54–84637.

*Primary Examiner*—Larry Jones

*Attorney, Agent, or Firm*—Ronald P. Kananen

[57] ABSTRACT

A gas heating apparatus comprises a duct constructed by a heat insulating material having a heat resisting property, a plurality of honeycombs disposed across in the duct so as to oppose to a direction of a gas flow in the duct, the honeycombs being formed of a material having a heat resisting property, and a plurality of heat radiating members disposed inside the duct so as to oppose to the honeycombs, respectively, for radiating heat to the honeycombs. The gas entering the duct flows therein and is heated during the passing through the honeycombs. The honeycombs are constituted as partition walls.

7 Claims, 4 Drawing Sheets

GAS HEATING APPARATUS

This application is a division of application Ser. No. 08/124,035, filed Sep. 21, 1993, now abandoned.

BACKGROUND OF THE INVENTION

The present invention relates to a gas heating apparatus for heating a gas to a high temperature.

There is generally known in the prior art a heat exchanger type heating apparatus in which a gas to be heated is contacted to a wall structure heated to a high temperature.

In this type of gas heating apparatus, it is required to provide a large heat transfer surface of the wall structure or to provide a large temperature difference between the wall structure and the gas due to the low coefficient of thermal conductivity between the higher temperature wall structure and the gas. Thus, it is extremely difficult to realize a compact structure of the gas heating apparatus.

In order to improve such defect, certain gas heating apparatus having a ceramic cylinder, in which an electrically heated heat generating means is disposed so as to enlarge the heat transfer surface, is already known.

In general, from the view point of energy efficiency, it is not preferable to generate whole energy for heating gas only by means of a simple electrical heater over the entire range of temperature. In the conventional gas heating apparatus it using an electric heater, it an extremely big size of apparatus is required in order to obtain the higher temperature gas, such as over 1,000° C., and, thus, it is not so practical.

SUMMARY OF THE INVENTION

An object of the present invention is to substantially eliminate defects or drawbacks encountered in the above prior art and to provide a gas heating apparatus having a compact structure suitable for heating the gas to a temperature of more than 1000° C. at lower cost.

This and other objects can be achieved according to the present invention by providing a gas heating apparatus comprising:

a duct means constructed by a heat insulating material having a heat resisting property;

a honeycomb means disposed across in the duct so as to oppose to a direction of a gas flow in the duct, the honeycomb means being formed of a material having a heat resisting property; and a heat radiating means disposed inside the duct so as to oppose to the honeycomb means for radiating heat to the honeycomb means.

In preferred embodiments, the honeycomb means is formed of a ceramic containing a main component other than metallic oxide, and in particular, a silicon carbide or silicon nitride is preferable as a material forming the honeycomb means.

In one embodiment, the heat radiating means is an electric heater.

In another embodiment, the heat radiating means is a combustion gas pipe means comprising a pipe structure having an upstream side portion with respect to a fuel flow direction which is formed as a venturi, a fuel supply pipe connected to the pipe structure at an upstream side of the venturi and a catalyst portion disposed at a downstream side of the venturi.

In yet another embodiment, the heat radiating means is a laser oscillator.

Further in the preferred embodiment, a plurality of the honeycomb means are disposed in the duct along the gas flow direction in the duct and a plurality of heat radiating means are disposed so as to oppose the corresponding honeycomb means, respectively. The honeycomb means comprises a partition wall disposed across in the duct with a through hole formed in the gas flow direction and a honeycomb fitted in the through hole.

According to the gas heating apparatus described above, the honeycomb disposed in the duct is heated by the heat radiated from the heat radiating means which is opposed to the honeycomb means. The gas supplied in the duct is heated as it passes through the honeycomb. This heating effect can be enhanced by locating a plurality of honeycombs and the heat radiating means.

The nature and further features of the present invention will be made more clear from the following descriptions made with reference to the accompanying drawings.

DESCRIPTION OF THE PREFERRED EMBODIMENTS

Figure 1:
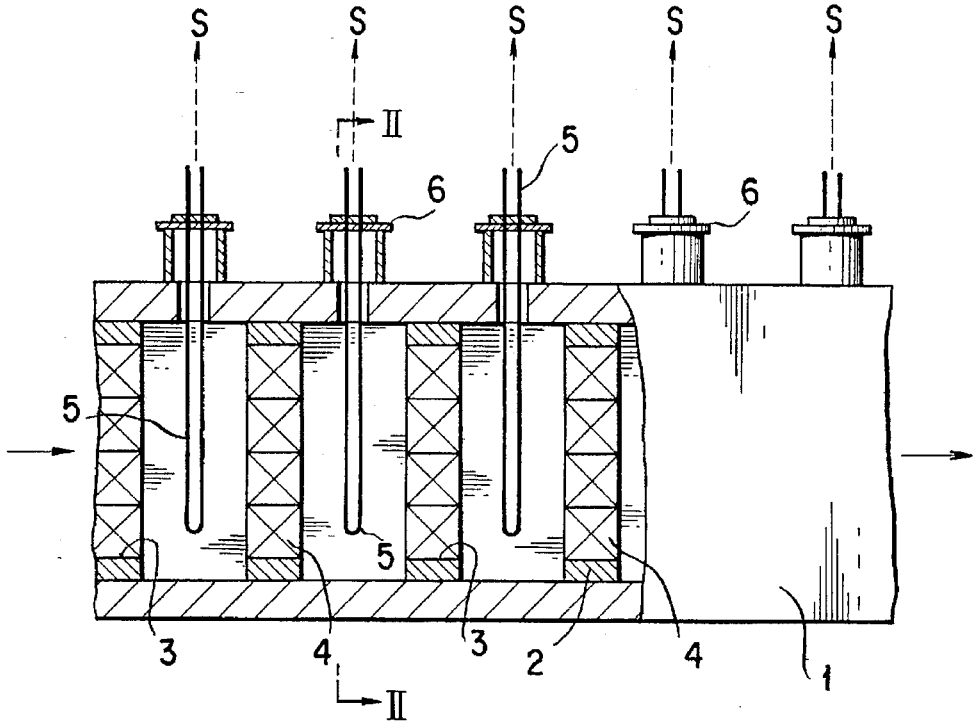
FIG. 1 is a front view, partially in section, of a first embodiment according to the present invention.
Figure 2:
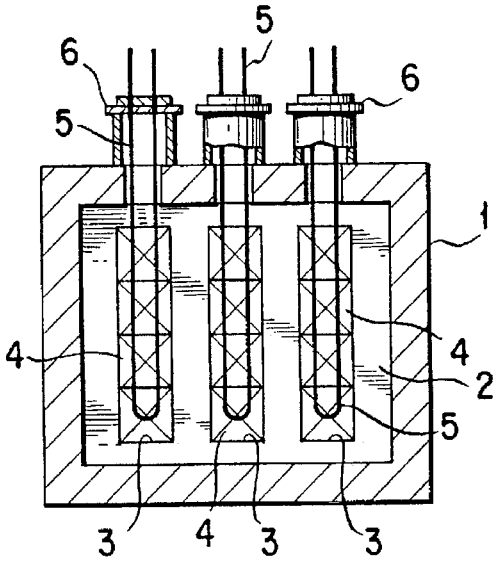
FIG. 2 is a sectional view taken along the line II—II of FIG. 1.

FIGS. 1 and 2 represent a first embodiment of a gas heating apparatus according to the present invention. Referring to FIG. 1, reference numeral 1 denotes a duct constituting a body of the gas heating apparatus and formed of a heat insulating material having a heat resisting property such as, for example, a ceramic. The inner space of the duct 1 is divided into a plurality of sections along a gas flow direction by means of a plurality of partition walls 2 each formed of a heat insulating material having a heat resisting property. The partition walls 2 are formed with window-like through holes 3 through which the gas flows from the upstream side to the downstream side in the duct 1, and honeycombs 4 made of a heat insulating material such as, for example, a ceramic are fitted to the respective window-like through holes 3.

Heat radiating members or radiaters 5 generating heat through current conduction are disposed in a perpendicular fashion opposing to the respective honeycombs 4 with respect to the gas flow direction in the duct 1. The heat radiating member 5 is formed of a wire-like material, as an electric heater, so as to provide a loop shape and has both ends secured to a flange member 6 fixedly mounted to the outer peripheral surface of the duct 1. Namely, as shown in FIGS. 1 and 2, both ends of the wire-like heat radiating member 5 extend outward of the duct 1 and are connected to a power supply source S, with the loop portion thereof being inside the duct 1.

The honeycomb 4 for use in a lower temperature range may be formed of a cordierite ($2MgO.\ 2Al_2O_3.5SiO_2$), but the honeycomb 4 for use in a higher temperature should be preferably formed by using a silicon carbide (SIC) or silicon nitride ($Si_3N_4$) instead of metallic oxide as a main component.

This is because the coefficient of thermal conductivity of such metallic oxide types of ceramic as cordierite, which are durable to use at 1350° C., is merely 0.9 Kcal/mh° C. at a temperature of 25° C. It is not practical to use such materials for the honeycomb at the higher temperature, because it induces the breakage of honeycomb caused by the large temperature inclination in the honeycomb along the direction of the gas flow.

This means that the necessary reduction of radiated energy from the thermal radiater should be a big barrier for designing the small size of gas heating apparatus.

On the other hand, the coefficients of thermal conductivity of the silicon carbide (SIC) and silicon nitride ($Si_3N_4$) are large, such as 38 Kcal/mh° C. and 16 Kcal/mh° C., respectively, and the available temperature difference range between both sides of the honeycomb is wide and large. Thus, can be a really desirable material to form the honeycomb to be heated by the thermal radiater.

A nichrome wire may be usable as a material for the heat radiating member 5 in a low temperature range, but the use of bisilicate molibdenum or silicon carbide may be preferred in a high temperature range.

In the above structure of the gas heating apparatus, the honeycombs 4 disposed in the duct 1 are heated with heat radiation generated from thermal radiater 5 by transmitting electric current. Under this condition, the gas is heated by the wall surfaces of the honeycombs while successively passing through the honeycombs 4.

In the present embodiment, the heat transfer surface area of each honeycomb is fully large enough to be able to transfer heat effectively from the heated honeycomb to gas, such as 2170 $m^2$, 2780 $m^2$ and 2780 $m^2$ in the cases of 300 cells, 400 cells and 600 cells, respectively.

Figure 3:
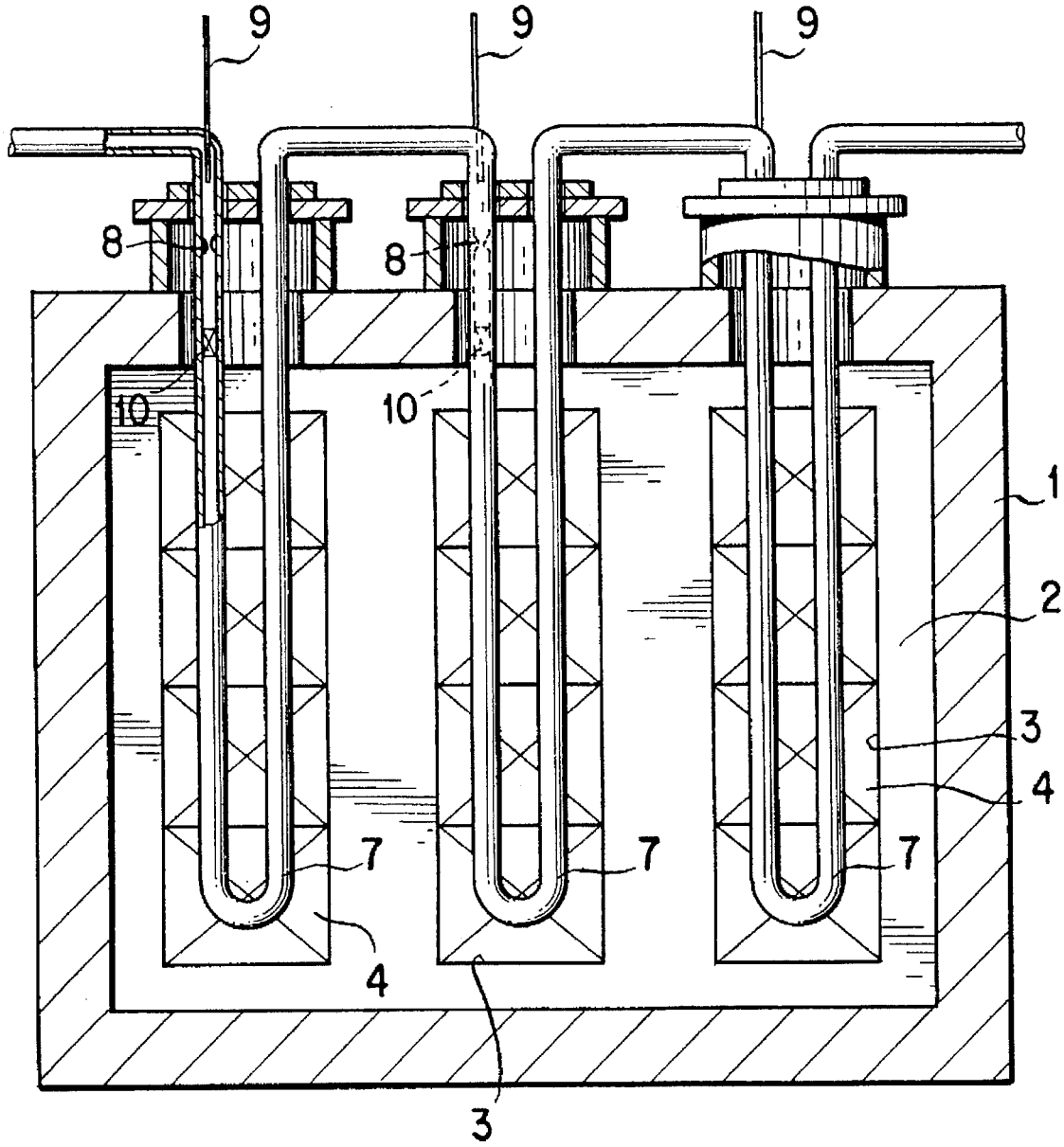
FIG. 3 shows an elevational section of a second embodiment according to the present invention.
Figure 4:
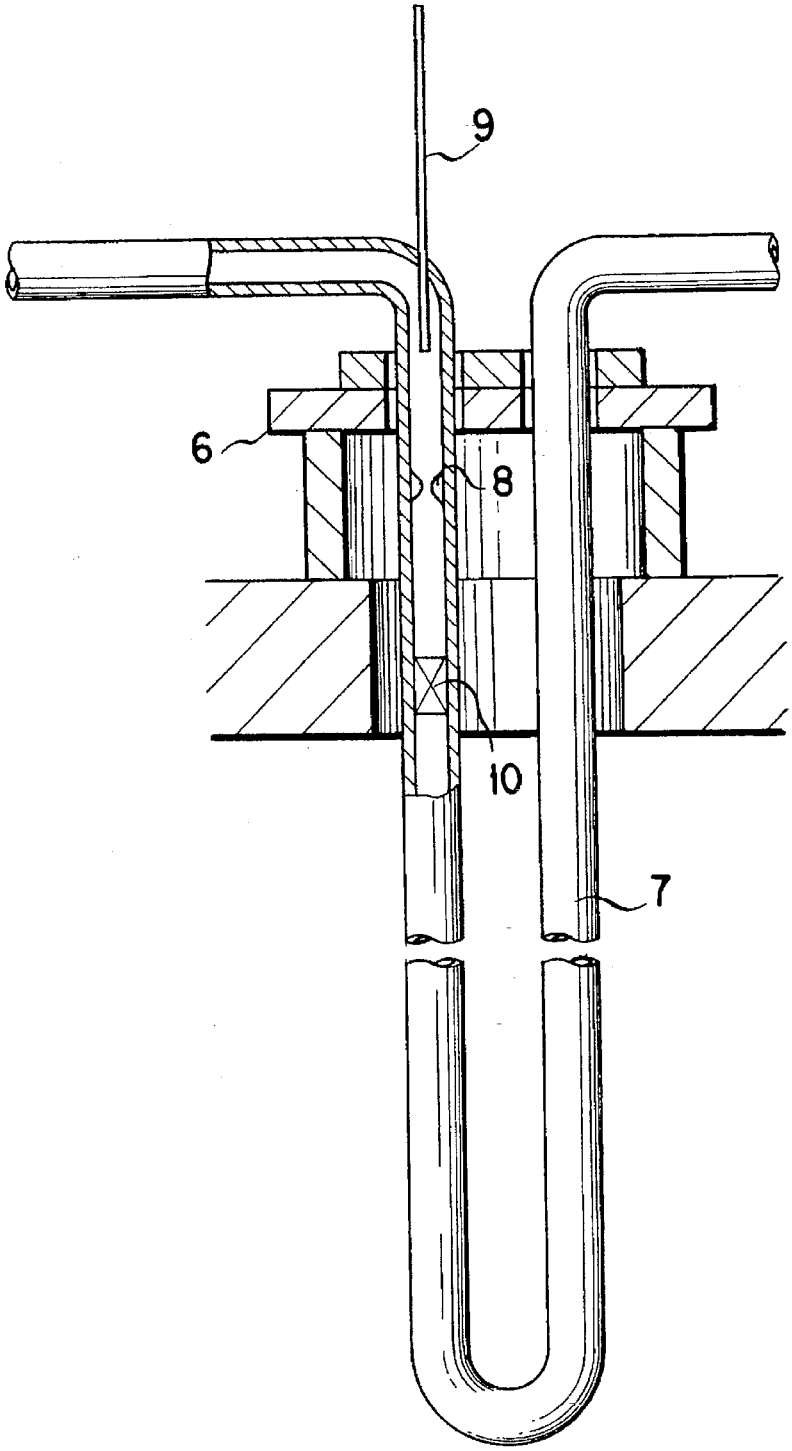
FIG. 4 is a sectional view, in an enlarged scale, of an essential structure of the heat radiating member of FIG. 3.

FIGS. 3 and 4 represent a second embodiment of a gas heating apparatus according to the present invention, and in this second embodiment, the heat radiating members 5 of wire-like structure in the first embodiment are replaced with combustion gas pipes 7 made of heat resisting steel, and the other arrangement is substantially equal to that of the first embodiment. Each of the combustion gas pipes 7 is disposed so as to oppose to the honeycomb 4 of the partition wall 2, and as clearly shown in FIG. 4, the combustion gas pipe 7 is provided with a venturi 8 for mixing a fuel at an upstream side of the pipe 7, a fuel supply pipe 9 disposed further upstream from the venturi 8 and a catalyst 10 for combustion disposed downstream from the venturi 8. According to this structure, the fuel supplied through the fuel supply pipe 9 is burned up in the combustion gas pipe 7 and the heat of the burned-up combustion gas is radiated as it passes through the combustion gas pipe 7.

A plurality of the combustion gas pipes 7, each having the structure described above and being disposed so as to oppose the corresponding honeycomb 4 of one partition wall 2, are connected in series, and air supplied from the most upstream side of the pipes 7 is subsequently consumed in the respective combustion gas pipes 7 to thereby carry out the combustion.

Figure 5:
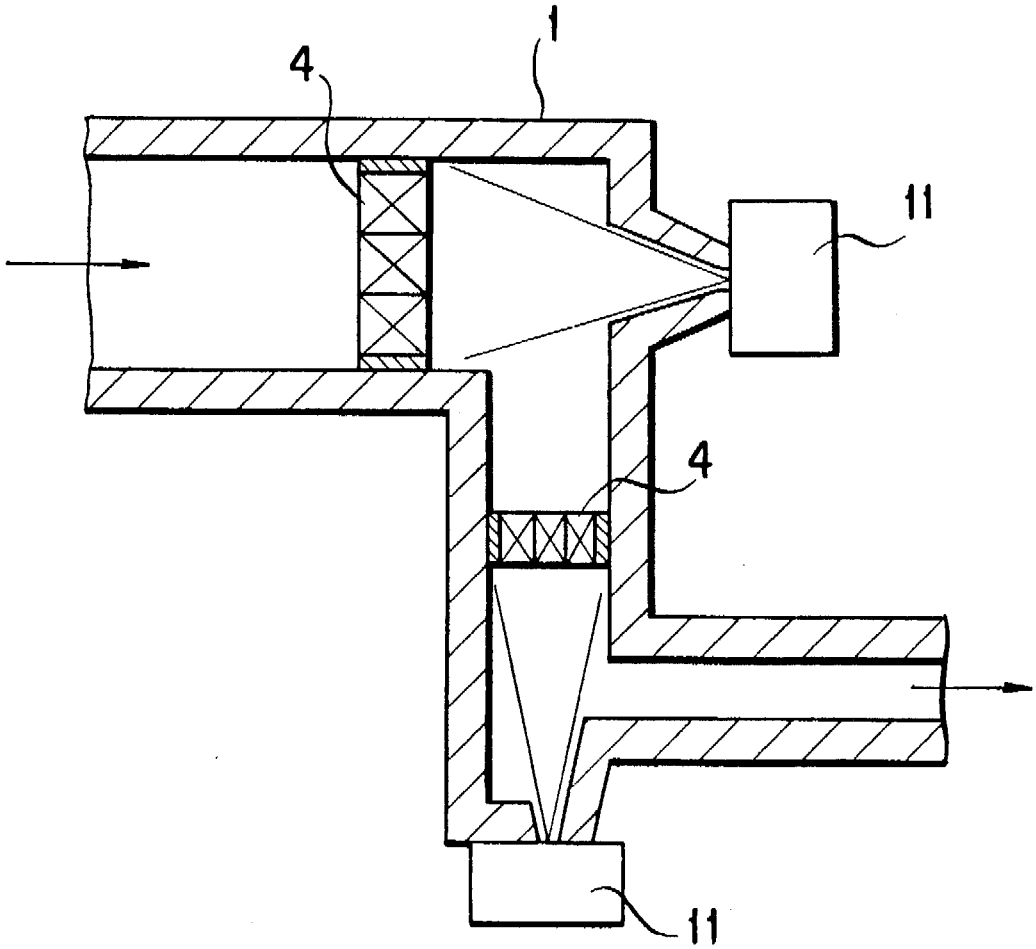
FIG. 5 is a sectional view showing a third embodiment according to the present invention.

FIG. 5 represents a third embodiment of a gas heating apparatus according to the present invention, in which a laser means is utilized for heating the respective honeycombs. Referring to FIG. 5, laser oscillators 11 are disposed opposingly to the respective honeycombs 4 to irradiate the laser to the entire surfaces of the honeycombs 4 to thereby heat the same.

Further, in the above-described preferred embodiments, the honeycombs 4 are fitted in the window-like holes 3 formed to the partition walls 2, but in a modification, the partition wall itself is constructed by the honeycomb.

According to the present invention, the heat radiated from the heat radiating members is received by the honeycombs and the gas is then heated by the extremely wide wall surface area of the honeycombs, so that the gas can be heated to a temperature of more than 1000° C. by the heating apparatus having a compact structure, thus making small in size the gas heating apparatus itself with reduced cost.

Furthermore, according to the heating apparatus of the present invention, the gas can be easily heated to a temperature of more than 1400° C., and still furthermore, in a case where an organic material is gasified, a tar-like substance can be decomposed in gas-like material or high molecular light gas oil by heating the tar-like substance together with a water steam of a proper amount.

Moreover, when city waste, refuse or the like is burned, dioxine is generated. However, in such case, the dioxine is not produced, even in a gas containing chlorine and hydrochloric acid gas, by completely decomposing benzene nucleus of the dioxane by passing it through the gas heating apparatus of the present invention.

What is claimed is:

1. A gas heating apparatus comprising:

a duct means constructed by a heat insulating material having a heat resisting property;

a honeycomb means disposed across the duct so as to be opposed to a direction of gas flow in the duct, said honeycomb means being formed of a material having a heat resisting property; and a heat radiating means disposed inside the duct so as to be opposed to said honeycomb means for radiating heat to the honeycomb means, said heat radiating means being composed of a combustion gas pipe comprising a pipe structure having an upstream side portion with respect to a fuel flow direction which is formed as a venturi, a fuel supply pipe connected to the pipe structure at an upstream side of the venturi and a catalyst portion disposed at a downstream side of the venturi.

2. A gas heating apparatus according to claim 1, wherein a plurality of said honeycomb means are disposed in the duct along the gas flow direction in the duct and a plurality of said combustion gas pipes are disposed so as to be opposed to corresponding honeycomb means, respectively.

3. A gas heating apparatus according to claim 2, wherein said gas pipes are connected in series.

4. A gas heating apparatus according to claim 1, wherein said honeycomb means comprises a partition wall disposed across the duct and having a through hole formed in the gas flow direction and a honeycomb fitted in the through hole.

5. A gas heating apparatus according to claim 1, wherein said heat radiating means heats a gas flowing in the duct to a temperature more than 1000 degrees C.

6. A gas heating apparatus according to claim 1, wherein said honeycomb means is arranged to heat a gas to be heated primarily through contact convection.

7. A gas heating apparatus according to claim 1, wherein said heat radiating means is arranged to heat a gas to be heated without admixing the gas with a burner gas in a burner gas pipe.

* * * * *